United States Patent [19]

Szekely

[11] 4,047,938

[45] * Sept. 13, 1977

[54] PROCESS FOR REFINING MOLTEN METAL

[75] Inventor: Andrew Geza Szekely, Yorktown Heights, N.Y.

[73] Assignee: Union Carbide Corporation, New York, N.Y.

[ * ] Notice: The portion of the term of this patent subsequent to Mar. 11, 1992, has been disclaimed.

[21] Appl. No.: 697,466

[22] Filed: June 18, 1976

Related U.S. Application Data

[60] Continuation-in-part of Ser. No. 536,954, Dec. 23, 1974, Pat. No. 3,980,742, which is a continuation-in-part of Ser. No. 323,785, Jan. 15, 1973, Pat. No. 3,870,511, which is a division of Ser. No. 211;950, Dec. 27, 1971, Pat. No. 3,743,263.

[51] Int. Cl.[2] ..... C22B 45/00

[52] U.S. Cl. ..... 75/67 A; 75/76; 75/78; 75/85; 75/86; 75/93 E

[58] Field of Search ..... 75/93 E, 67, 76, 78, 75/85, 86

[56] References Cited

U.S. PATENT DOCUMENTS 3,870,511 3/1975 Szekely ..... 75/68 R

*Primary Examiner*—M. J. Andrews

*Attorney, Agent, or Firm*—Saul R. Bresch

[57] ABSTRACT

In a process for refining molten metal selected from the group consisting of magnesium, copper, zinc, tin, and lead comprising the steps of:

1. feeding the molten metal into a refining zone;
2. providing a gas injection device submerged in said molten metal comprising (a) a shaft fixedly attached to a vaned rotor at its lower end, (b) a stationary sleeve surrounding said shaft, and (c) a passageway for conveying and discharging refining gas into the molten metal running the length of said gas injection device;
3. introducing refining gas into the upper end of said passageway under sufficient pressure to be injected into the melt;
4. withdrawing the spent refining gas and the dissolved gases released by the metal while collecting other non-metallic impurities in a slag layer on the surface of the molten metal; and
5. withdrawing the refined molten metal from said refining zone.

12 Claims, 5 Drawing Figures

PROCESS FOR REFINING MOLTEN METAL

This application is a continuation-in-part of application Ser. No. 536,954 filed Dec. 23, 1974, now U.S. Pat. No. 3,980,742 which is, in turn, a continuation-in-part of application Ser. No. 323,785 filed Jan. 15, 1973, now U.S. Pat. No. 3,870,511 issued on Mar. 11, 1975, which is, in turn, a division of application Ser. No. 211,950 filed Dec. 27, 1971, now U.S. Pat. No. 3,743,263 issued on July 3, 1973.

BACKGROUND

This invention relates in general to refining of molten metal, and more particularly, to a method for removing dissolved gases and non-metallic impurities from molten metal without the emission of corrosive or environmentally harmful gases and fumes.

Molten metal, prior to casting, contains many impurities which, if not removed, cause high scrap loss in casting, or otherwise cause poor metal quality in products fabricated therefrom. The principal objectionable impurities are dissolved gases and suspended non-metallic particles such as metal oxides and refractory particles.

It is an object of this invention to provide a process for refining metal with refining gas which efficiently removes dissolved gases and other non-metallic impurities from the metal in a continuous process at high metal throughput rates.

The above object and others, which will be apparent to those skilled in the art, are achieved by a process for removing dissolved gases and non-metallic impurities from a molten metal selected from the group consisting of magnesium, copper, zinc, tin and lead comprising the steps of:

1. feeding the molten metal into a refining zone;
2. maintaining a protective atmosphere above the surface of the molten metal at a positive pressure relative to the ambient pressure, thereby preventing infusion of air and moisture into said zone and contact of the molten metal therewith;
3. introducing a refining gas in the form of discrete bubbles into the molten metal beneath the surface of the melt;
4. stirring the molten metal in the refining zone to create a circulation pattern in the molten metal relative to the points of entry of the gas bubbles in the melt such that the gas bubbles introduced into the melt are transported substantially radially outward, relative to said points of entry of the bubbles, thereby prolonging the residence time of the gas bubbles in the melt and causing the gas bubbles to come into intimate content with substantially the entire mass of molten metal in said refining zone;
5. withdrawing the spent refining gas and the dissolved gases released by the metal while collecting and separating the other non-metallic impurities in a slag layer on the surface of the molten metal; and
6. withdrawing the refined molten metal from said refining zone.

The term "refining gas" as used herein is meant to include gases which are conventionally used in the refining of magnesium, copper, zinc, tin, and lead. The common characteristic of these refining gases is that they are inert towards the molten metal being refined. Argon and nitrogen or mixtures thereof are preferred although other inert gases of the periodic table are suitable for the present invention. Other useful refining gases are hydrogen and carbon monoxide or mixtures thereof with each other or the inert gases of the periodic table. It will be noted that hydrogen and carbon monoxide may be used in instances where they will not react with the molten metal, but will react with gaseous impurities such as oxygen. Other reactive gases with similar characteristics can also be used such as sulfur hexafluoride, chlorine, and halogenated hydrocarbons. Selection of a particular refining gas is generally made in accordance with the characteristics of the particular metal being refined.

The term "metal" as used throughout the specification and claims is meant to include pure metal as well as alloys of the metal.

DRAWINGS

Detailed Description

The gas injection device suggested for use in the present invention is characterized by its ability to inject gas at high flow rates into molten metal in the form of discrete gas bubbles and to achieve a high degree of gas dispersion throughout the melt. The device, when in operation, induces flow patterns in the metal in the vicinity of the device such that the gas bubbles which are formed, are transported along a resultant flow vector which is radially outward with a downward component relative to the vertical axis of the injection device. These flow patterns have several advantageous effects. First, essentially vertical stirring is provided for the entire body of the melt, whereby a downwardly directed flow along the device, in combination with the rotating vanes, causes subdivision of the gas into small discrete gas bubbles. Second, the rapid conveyance of the gas bubbles away from the point of introduction into the melt prevents bubble coalescence in the zone where the gas bubble concentration is the highest. Third, the gas residence time of the well dispersed gas bubbles in the melt is prolonged, because the gas bubbles do not immediately, upon formation, rise to the surface under the influence of gravity.

Another factor which contributes to maximization of the subdivision of the gas into small bubbles, and hence leading to a large metal-gas interfacial area, is the preheating of the gas before it enters the melt. Such preheating is provided in the present invention by conducting the gas through a passageway running the length of the device which is submerged in the hot molten metal. Thus, the initially cold gas is preheated by contact with the hot, heat conducting walls of the gas passageway, whereby the gas is expanded before being subdivided into gas bubbles. Consequently, the number of bubbles generated from a given volume of gas is increased substantially, and thermal growth of the small bubbles in the melt is substantially prevented.

When used for injecting refining gas into molten metal, the injection device produces an unanticipated improvement in the efficiency of the refining operation. In addition to being able to degas the metal at a high throughput rate, the vigorous stirring action produced by the device, coupled with the large gas/metal contact area of the well distributed gas bubbles, assure efficient removal of solid particulate impurities suspended in the melt.

Figure 1:
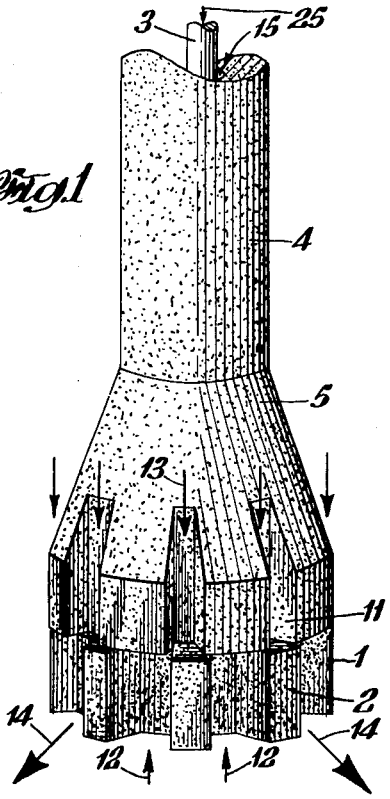
FIG. 1 is a perspective view of a gas injection device for use in the present invention.
Figure 2:
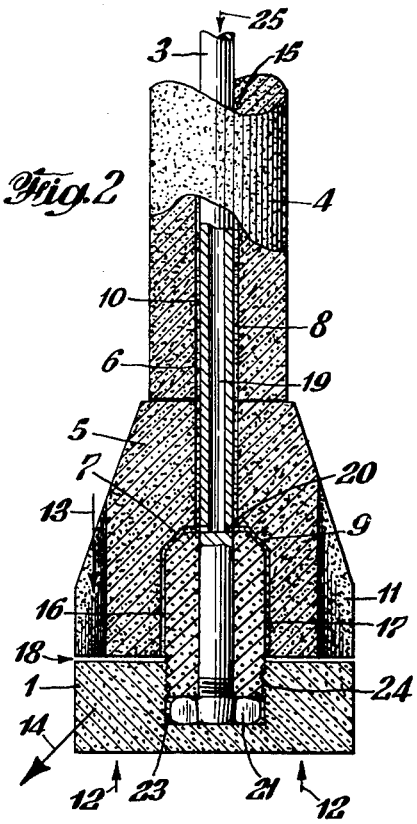
FIG. 2 is a cross-sectional view of the device shown in FIG. 1.

As shown in FIGS. 1 and 2, the gas injection device consists of rotor 1, equipped with vertical vanes 2, and rotated by means of a motor, such as an air motor or electric motor (not shown) through shaft 3. Shaft 3 which does not contact the melt during normal operation, may be constructed of steel, while the remainder of the equipment is preferably constructed from a refractory material, such as commercially available graphite or silicon carbide, materials which are inert toward the metal at the operating temperatures involved. Shaft 3 is shielded from the molten metal by sleeve 4, which is fixedly attached to stator 5. The abutting inner surfaces 6 and 7 respectively, of sleeve 4 and stator 5, and the abutting outer surfaces 8 and 9 respectively, of shaft 3 and rotor 1, form an annular axial passageway 10 for the gas to be injected.

A plurality of vertical channels 11 are machined into stator 5. The combination of stator 5 and rotor 1, when in operation, induce an upper and lower flow pattern of molten metal around the injection device as indicated generally by the arrows 13 and 12, respectively. Specifically, the upper flow pattern 13 has a main velocity vector pointing essentially downward, i.e. it is coaxial with the axis of rotation of the rotor 1, thereby forcing the molten metal through the channels 11 of stator 5; the lower, more localized flow pattern indicated by arrows 12, develops beneath the rotor 1 and is pointed essentially upward and perpendicular to the axis of rotation of the rotor 1. The resultant flow of these components is indicated by arrows 14, which show that the molten metal is forcefully discharged by the rotating vanes 2 radially and downwardly away from rotor 1. The resultant flow pattern causes a well distributed and uniform gas dispersion and a thorough agitation of the molten metal within the treating vessel.

A refining gas (indicated by arrow 15) is introduced into the annular passageway 10 at a predetermined pressure and flow rate. The gas fills the bell shaped pocket 16 which is a continuation of passageway 10 surrounding neck 17 of rotor 1. Since the gas is supplied at a pressure greater than the pressure prevailing in the molten metal at a height indicated by arrow 18, the gas pocket 16 prevents molten metal from running back through the gas passage and from coming in contact with the metal shaft 3 of the gas injector. Neck 17 surrounds shaft 3 and is constructed from a material resistant to the molten metal in order to protect shaft 3 from attack by the molten metal. As shown in FIG. 2, the torque from shaft 3 is transferred to rotor 1 by means of winged cross-piece 21 which is threaded to shaft 3. Cross-piece 21 is placed during assembly into cavity 23 of rotor 1, the cavity 23 having a shape corresponding to that of cross-piece 21. Thereafter, cavity 23 is sealed by threading and cementing neck 17 into thread 24 in rotor 1.

The introduction of refining gas 15 into annular passageway 10 need not necessarily be the sole means of providing the gas to be injected. An alternate embodiment of the invention may include a hollow shaft, wherein a passageway 19 extends axially through shaft 3 and is provided with a plurality of drillings 20 which provide communication with passageway 10 and gas pocket 16. Thus, gas (indicated by arrows 15 and 25) may be provided through either passageway 10 or passageway 19 or both.

It is important that the cold gas (indicated by arrows 15 and 25) entering the injector be preheated during its passage through passageway 10 or passageway 19, and gas pocket 16 by contacting the sleeve 4 and shaft 3 which are essentially at the temperature of the melt. The preheated gas is forced between the vanes of the rotor 1 where it is broken up into small discrete bubbles by collision with the vanes 2 and by the metal flow sweeping past the vanes. The forced circulation of the metal around the injector device rapidly disperses the gas bubbles as they are formed in a direction essentially along the main flow velocity vector, indicated by arrows 14. The initial trajectory of the gas bubbles follows the direction of the arrows 14 until the buoyancy force prevails and causes the gas bubbles to rise to the surface of the melt.

The beneficial effects of the forced circulation pattern of the metal around the injection device include the following: (1) the provision of an efficient mechanism for small gas bubble formation, (2) the prevention of bubble coalescence by dispersing the small gas bubbles almost simultaneously with their formation, (3) the provision of efficient circulation of the metal, and (4) prolonged residence time of the gas bubbles in the melt beyond the time they would remain in the melt if gravity were the sole force acting upon them.

Figure 3:
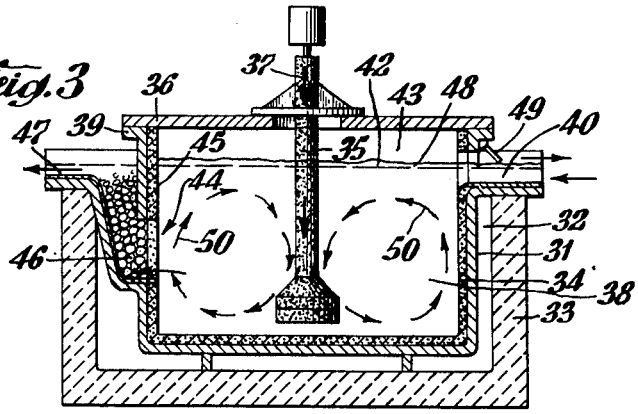
FIG. 3 is a schematic diagram in cross-section illustrating a preferred system for refining a metal stream in a continuous process in accordance with the present invention.

The process of the invention can be carried out in a batch-type operation, or in a continuous operation by using a refining system such as shown in FIG. 3. The refining system comprises a cast iron shell 31 which is maintained at its operating temperature by conventional heating means which may be located in well 32, and is insulated against heat loss by an outer refractory shell 33. The inner surface of shell 31 is lined with graphite 34 or with other refractory materials which are inert to the molten metal and non-metallic impurities likely to be present. Shell 31 is provided with a cover 36 which rests upon flanges 39. A gas-tight seal is provided between flanges 39 and cover 36 which may be bolted or otherwise fastened thereto, thereby allowing the system to be operated without the infiltration of air. A gas injection device 35, such as that shown in FIG. 1, is fastened to cover 36 and supported therefrom.

Refining gas (indicated by arrow 37) is injected into molten metal 38 by gas injector 35. The gas after passing through the molten metal, collects in head space 43 to form an inert gas blanket over the melt and leaves through metal inlet port 40 counter-current to the incoming flow of metal. The free cross-sectional area of the gas passage, and hence the pressure in the system, is regulated by damper 49 located in port 40. The slightly pressurized inert gas in head space 43 prevents air leakage into the vessel.

Entry of the metal 38 into the refining system is through metal inlet port 40. Inside the vessel, metal 38 is sparged by the uniformly distributed small bubbles of inert gas and is agitated by the action provided by the rotating gas injector 35. Gases dissolved in the melt diffuse into and are carried away by the bubbles of inert gas as they rise through the melt to the melt surface 42. The large surface area of the finely dispersed gas bubbles also serves as an efficient transport means for suspended non-metallic particles to slag layer 48 at the melt surface 42 from where they can be removed by skimming. The major overall circulation pattern developed in the molten metal are schematically shown by arrows 50. It is this induced flow pattern of metal in the vessel which continues to bring fresh metal into contact with the gas bubbles which are being discharged from the space between the rotor and stator of the injection device.

The refined molten metal leaves the refining vessel through discharge port 44 situated below the metal surface 42 in wall 45. The metal then passes through well 46 and leaves the system through exit trough 47 to a casting station. Well 46 may contain a conventional filtering medium, such as, graphite or solid refractory chips.

Skimming of the metal surface 42 may be accomplished by the mode of construction of the refining vessel or by stopping the inlet flow of metal to the refining vessel while maintaining the flow of inert gas 37 through gas injector 35 so as to push the slag layer 48 into inlet trough 40 from where it may be removed by mechanical means. Alternatively, metal surface 42 can be skimmed by means of a hand tool inserted into shell 31 through inlet trough 40 or through an opening (not shown) in cover 36.

Figure 4:
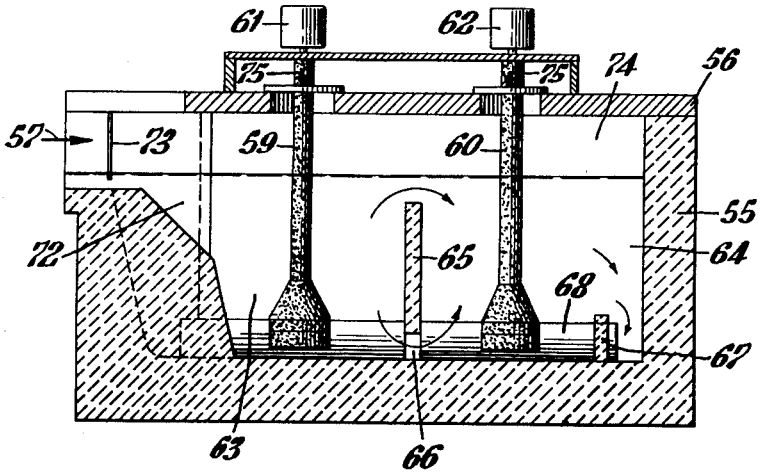
FIGS. 4 and 5 are a cross-sectional and a top view, respectively, of another preferred embodiment of apparatus suitable for refining molten metal in accordance with the present invention.
Figure 5:
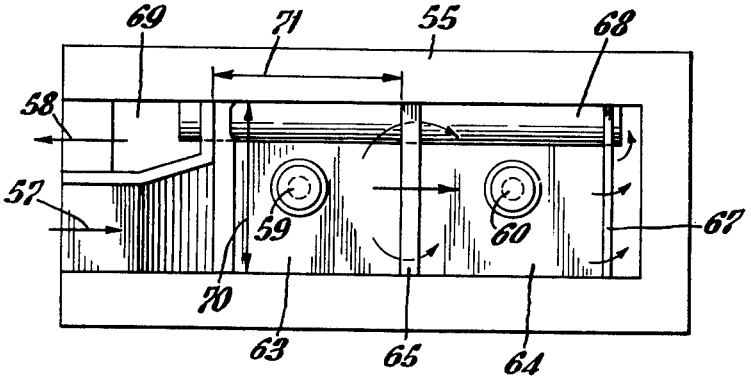

The refining operation is not restricted to being carried out in a single refining zone as shown in FIG. 3; rather, the vessel may contain a plurality of individual refining compartments or zones through which the molten metal passes in series. FIGS. 4 and 5 illustrate such an alternate arrangement.

The refining vessel 55, shown in FIGS. 4 and 5, is constructed from a refractory which is inert to the molten metal, and is insulated against heat losses with high temperature insulating materials. If necessary, the vessel may also be provided with electric heating elements (not shown) to compensate for heat losses. Refining vessel 55 is provided with a cover 56 which is attached to vessel 55 gas-tight leaving only the metal inlet trough 57 unsealed. Gas injectors 59 and 60 which are of the type described in FIG. 1, and their respective drives 61 and 62 are supported by cover 56. Arrows 75 indicate inert gas entering gas injectors 59 and 60 through their respective inlet ports.

The refining vessel 55 is intended to be used in continuous operation, i.e., molten metal is continuously supplied through inlet trough 57 into the vessel 55, the metal is refined by continuous agitation and gas injection through injectors 59 and 60, and the refined metal is continuously withdrawn from the vessel via exit trough 58. Reference to FIG. 5 shows that refining vessel 55 is provided with two refining zones 63 and 64 separated by a baffle plate 65. The metal first enters refining zone 63 where it is agitated and sparged with an inert gas provided by gas injector 59. The metal leaves the refining zone 63, in part by overflow over the top of baffle plate 65, and partly by underflow through ports 66 provided in baffle plate 65. The metal is further refined in the second refining zone 64 where it is similarly agitated and sparged with inert gas provided by gas injector 60. The metal leaves refining zone 64 by overflowing the bottom baffle plate 67 and entering exit pipe 68. Exit pipe 68 is fabricated from a refractory material, such as graphite or silicon carbide and serves to conduct the refined molten metal from refining zone 64 to exit well 69 where it leaves the refining vessel through exit trough 58.

The refining gas introduced into the system passes through the molten metal, collects in head space 74 above the metal and leaves the refining vessel 55 through inlet trough 57 above and in counter-current flow to the entering molten metal. The pressure in the refining vessel 55 may be adjusted by a hinges damper 73, located in inlet trough 57, by regulating the free cross-sectional area of the gas passage in inlet trough 57. Thus, it is possible to provide, in addition to the static seal provided by cover 56, a dynamic gas seal for the refining vessel by operating vessel 55 slightly above the ambient pressure so as to prevent air from entering the vessel.

A distinct advantage of the system of the present invention is that it can be readily adjusted to supply the refining gas requirements for different metals and the speed of refining can be matched to a wide range of casting rates. The specific refining gas requirement, generally expressed as volume of gas at normal temperature and pressure per unit weight of metal to be treated, is a function of the composition of the alloy and the degree of purity required in the finished product. The flow rate of metal through the refining system may be governed by the speed of casting, i.e., by the type of casting machines used and by the number of ingots cast simultaneously from the refined metal. The following illustrates a convenient way by which operating conditions in the system may be adjusted depending upon the particular alloy to be refined and the desired rate of refining in accordance with the present invention.

Initially, the flow rate of the refining gas per gas injection device is calculated from the following formula:

$$V = W . C/N \quad (1)$$

where:

$V$ = the flow rate of the refining gas through the device, normal cu.ft./min;

$W$ = the metal flow rate or refining rate, lbs/min;

$C$ = the specific refining gas requirement, normal cu.ft./lb. metal;

$N$ = the number of gas injection devices in the system.

The specific refining gas requirement, "C", is determined by experimentation or, for purposes of start-up, it can be estimated based on the amount of refining gases used for refining the particular metal in conventional practice.

After having determined the necessary gas flow rate through the injection device, the speed of rotation of the rotor is adjusted in accordance with the following formula:

$$R = (300 + 750V + 83r^2)/d \quad (2)$$

where:

$R$ = the speed of rotation of the rotor, (RPM);

$V$ = the gas flow rate through the device as calculated from formula (1), normal cu.ft./min;

$r$ = the ratio of the least cross-sectional dimension of the refining zone around the rotor to the diameter of the rotor (calculated with consistent units); for example, in the refining system shown in FIG. 5, the least cross-sectional dimension of refining zone 63 is the smaller of the two dimensions indicated by arrows 70 and 71;

$d$ = the diameter of the rotor, inches.

This formula yields an approximate RPM for the rotor which ensures a satisfactory dispersion of the refining gas and a good stirring of the metal bath under most operating conditions. From the formula it can be seen that the speed of the rotor must be increased with increasing refining gas flow rates. It should be noted, however, that it is possible to operate the device at significantly lower speeds than predicted by this formula, the optimum speed being dictated primarily by the desired degree of refining.

What is claimed is:

1. A process for refining a molten metal selected from the group consisting of magnesium, copper, zinc, tin and lead comprising the steps of:

a. feeding the molten metal into a refining zone;

b. maintaining a protective atmosphere above the surface of said molten metal at a greater than atmospheric pressure, thereby preventing contact of the melt with air or atmospheric moisture;

c. providing a gas injection device submerged in said molten metal comprising (i) a shaft fixedly attached to a vaned rotor at its lower end, (ii) a stationary sleeve surrounding said shaft, and (iii) a passageway for conveying and discharging refining gas into the molten metal running the length of said gas injection device;

d. introducing a refining gas into the upper end of said passageway under sufficient pressure to be injected into the melt;

e. preheating the refining gas by contact thereof with the hot walls of the passageway, whereby the gas is expanded, before being sub-divided into gas bubbles, to the point where thermal growth of said bubbles in the melt is substantially prevented;

f. directing the preheated refining gas to the vanes of said rotor of said gas injection device;

g. sub-dividing the refining gas into discrete gas bubbles by rotating said vaned rotor at a speed sufficient to create a circulation pattern in the molten metal such that the gas bubbles are transported substantially radially outward with a downward component relative to their points of entry into the melt thereby coming into intimate contact with substantially the entire mass of molten metal in said refining zone, resulting in the removal of dissolved gases and substantially all non-metallic impurities from said melt;

h. withdrawing the spent inert gas and the dissolved gases released by the metal while collecting other non-metallic impurities in a slag layer on the surface of the molten metal; and i. withdrawing the refined molten metal from said refining zone.

2. The process of claim 1 wherein said refining gas is argon.

3. The process of claim 1 wherein said refining gas is nitrogen.

4. The process of claim 1 wherein said refining gas is a mixture of argon and nitrogen.

5. The process of claim 1 wherein said passageway is formed by the outer surface of said shaft and the inner surface of said stationary sleeve.

6. The process of claim 1 wherein said passageway extends axially through said shaft.

7. A process for refining a molten metal selected from the group consisting of magnesium, copper, zinc, tin, and lead comprising the steps of:

a. providing a refining vessel for containing molten metal, said vessel containing at least one refining zone;

b. feeding molten metal into the refining vessel;

c. maintaining a protective atmosphere above the surface of the molten metal at a greater than atmospheric pressure, thereby preventing contact of the molten metal with air or atmosphere moisture;

d. providing at least one gas injection device in said refining vessel submerged in said molten metal comprising (i) a shaft fixedly attached to a vaned rotor at its lower end, (ii) a stationary sleeve surrounding said shaft, and (iii) a passageway for conveying and discharging refining gas into molten metal running the length of said gas injection device;

e. introducing refining gas into the upper end of said passageway under sufficient pressure to be injected into the melt, the flow rate of said gas being defined by the following formula:

$$V = W\,C/N$$

where:

$V$ = flow rate of gas through each injection device, normal cu.ft./min.

$W$ = the feed rate of molten metal into said refining vessel, lbs/min.

$C$ = the specific refining gas requirement in normal cubin feet/pound metal $N$ = the number of gas injection devices in said refining vessel;

f. sub-dividing the refining gas into discrete gas bubbles by rotating said vaned rotor at a speed sufficient to create a circulation pattern in the molten metal such that the gas bubbles are transported substantially radially outward with a downward component relative to their points of entry into the melt, resulting in the removal of dissolved gases and substantially all non-metallic impurities from the aluminum melt;

g. withdrawing the spent refining gas and the dissolved gases released by the metal while collecting other non-metallic impurities in a slag layer on the surface of the molten metal; and h. withdrawing the refined molten metal from said refining vessel.

8. The process of claim 7 wherein said gas injection device is operated at a speed approximately as defined by the following formula:

$$R = (300 + 750V + 83r^2)\,/d$$

where:

$R$ = rotational speed of the rotor, RPM;

$V$ = gas flow rate through the injection device, normal cu.ft./min.

$r$ = the ratio of the least cross-sectional dimension of the refining zone to the diameter of the rotor (dimensionless); and $d$ = the diameter of the rotor, inches.

9. The process of claim 7 wherein said inert gas is argon.

10. The process of claim 7 wherein said gas inert with respect to the metal is nitrogen.

11. A process for refining molten metal selected from the group consisting of magnesium, copper, zinc, tin, and lead comprising the steps of:

a. feeding molten metal into a refining zone;

b. maintaining a protective atmosphere above the surface of said molten metal at a greater than atmospheric pressure, thereby preventing contact of the melt with air or atmospheric moisture;

c. introducing a refining gas into said melt beneath the surface thereof;

d. preheating said refining gas before being sub-divided into gas bubbles by expanding the gas to the point where thermal growth of said bubbles in the melt is substantially prevented;

e. sub-dividing the refining gas into discrete gas bubbles;

f. creating a circulation pattern in the molten metal such that the bubbles of said refining gas are transported substantially radially outward with a downward component relative to their points of entry into the melt, whereby said gas bubbles come into intimate contact with substantially the entire mass of molten metal in said refining zone, resulting in the removal of dissolved gases and substantially all nonmetallic impurities from said melt;

g. withdrawing the spent refining gas containing the dissolved gases released by the metal, while collecting other non-metallic impurities in a slag layer on the surface of the molten metal; and h. withdrawing the refined molten metal from said refining zone.

12. The process of claim 11 wherein said refining gas with respect to the metal is selected from the group consisting of argon, nitrogen and mixtures thereof.

* * * * *